US010081949B2

(12) United States Patent
Honein

(10) Patent No.: US 10,081,949 B2
(45) Date of Patent: Sep. 25, 2018

(54) INTERCHANGEABLE BRACKET FLANGE SYSTEM

(71) Applicant: Jad Honein, Seattle, WA (US)

(72) Inventor: Jad Honein, Seattle, WA (US)

( * ) Notice: Subject to any disclaimer, the term of this patent is extended or adjusted under 35 U.S.C. 154(b) by 0 days.

(21) Appl. No.: 15/192,818

(22) Filed: Jun. 24, 2016

(65) Prior Publication Data

US 2016/0377221 A1 Dec. 29, 2016

Related U.S. Application Data

(60) Provisional application No. 62/495,581, filed on Jun. 26, 2015.

(51) Int. Cl.
*E04F 11/18* (2006.01)

(52) U.S. Cl.
CPC ... *E04F 11/1804* (2013.01); *E04F 2011/1821* (2013.01); *E04F 2011/1829* (2013.01)

(58) Field of Classification Search
CPC ..... E04F 11/1812; E04F 11/1804; E04F 11/1814; A47F 2010/065; A47F 3/12; E04H 17/1421; Y10T 403/46; Y10T 403/4697; Y10T 403/55
See application file for complete search history.

(56) References Cited

U.S. PATENT DOCUMENTS

| | | | |
|---|---|---|---|
| D34,046 | S | 2/1901 | Burrowes |
| 1,119,839 | A | 12/1914 | Kuhn |
| 1,316,155 | A | 9/1919 | Harrison et al. |
| 1,771,220 | A | 7/1930 | Hench |
| 1,772,159 | A | 8/1930 | Roth |
| 2,571,937 | A | 10/1951 | Peck |
| 2,969,955 | A | 1/1961 | Newman |
| 3,004,751 | A | 10/1961 | Woodward |
| 3,021,551 | A | 2/1962 | Kramcsak, Jr. |
| 3,049,323 | A | 8/1962 | Peterka |
| D205,282 | S | 7/1966 | Hern |
| 3,428,300 | A | 2/1969 | Sconzo |
| 3,430,407 | A | 3/1969 | Berry |
| 3,472,489 | A | 10/1969 | Baylin |
| D216,458 | S | 1/1970 | Nestrock |
| 3,516,644 | A | 6/1970 | Horgan, Jr. |

(Continued)

FOREIGN PATENT DOCUMENTS

| | | |
|---|---|---|
| CN | 3043388 | 4/1996 |
| CN | 3381282 | 7/2004 |

(Continued)

OTHER PUBLICATIONS

Aluminium Profiles & Extrusions, URL=http://www.goodingalum.com/p10/c2/Aluminium-Profiles-Extrusions, Aug. 28, 2015, 1 page.

(Continued)

*Primary Examiner* — Bradley Duckworth
(74) *Attorney, Agent, or Firm* — Caesar Rivise, PC

(57) ABSTRACT

Interchangeable bracket flange systems can be designed to connect any type of bracket to any type of material, including wood, concrete, glass, steel, sheet rock, etc., using a wall, glass, or steel adaptor flange. The adaptor flanges, the brackets, and the interchangeable bracket flange systems as a whole can have a smooth look, with no exposed screws, when installed.

5 Claims, 9 Drawing Sheets

(56) References Cited

U.S. PATENT DOCUMENTS 3,804,374 A 4/1974 Thom
D237,269 S 10/1975 Edwards
D240,681 S 7/1976 Granatelli
3,972,639 A 8/1976 Lening
4,125,249 A 11/1978 Zen
4,193,585 A 3/1980 Eandi
4,408,749 A 10/1983 Zieg
D272,473 S 1/1984 Larsson
4,783,189 A 11/1988 Bugg
4,999,961 A 3/1991 McNary
D316,430 S 4/1991 Andersen
5,131,541 A 7/1992 Liebel
D359,997 S 7/1995 Knudsen
5,437,433 A 8/1995 Rezek
5,481,846 A 1/1996 Macchietto
5,535,941 A 7/1996 Garza
5,673,848 A 10/1997 Garza
5,799,797 A 9/1998 Braun
5,836,123 A 11/1998 Gulino
D402,879 S 12/1998 Beard, Jr.
5,908,185 A * 6/1999 Collette ..... B64C 27/82 248/345.1
D419,427 S 1/2000 Mulder
D427,440 S 7/2000 Rowan
D429,998 S 8/2000 Snell
6,132,018 A * 10/2000 McGrath ..... A47F 3/007 248/398
D444,865 S 7/2001 Gottwald
6,290,212 B1 * 9/2001 Bartel ..... E04F 11/181 256/59
D468,191 S 1/2003 Burke
D469,004 S 1/2003 Winig et al.
D475,145 S 5/2003 Melvin
D481,560 S 11/2003 Vidmar et al.
6,698,725 B1 3/2004 Berry
6,736,373 B2 5/2004 Greaves
D493,588 S 7/2004 DeFelice
6,758,017 B2 7/2004 Young
D498,136 S 11/2004 Parker
D502,550 S 3/2005 Walker
D508,572 S 8/2005 Suggate
6,938,868 B2 * 9/2005 Pence ..... A47K 3/30 16/DIG. 24
7,044,450 B2 * 5/2006 Striebel ..... E04F 11/1812 256/59
D543,287 S 5/2007 Neuhofer, Jr.
D549,842 S 8/2007 Beard, Jr.
D552,264 S 10/2007 Collins, IV
D552,454 S 10/2007 Fynn
D557,049 S 12/2007 Sedwick et al.
D557,432 S 12/2007 Smith
D560,483 S 1/2008 Mercier
D573,726 S 7/2008 Coates
D582,572 S 12/2008 Hill, III
D583,965 S 12/2008 Castellanos
D586,075 S 2/2009 Wiley
D587,022 S 2/2009 Goodman et al.
D594,993 S 6/2009 Becht, IV et al.
7,540,472 B2 6/2009 Striebel et al.
7,614,612 B2 11/2009 Edwards
D621,527 S 8/2010 Sawyer
7,789,377 B2 9/2010 Gallea
D629,283 S 12/2010 Spira
7,877,943 B2 2/2011 Hikai
7,967,522 B2 * 6/2011 Goad ..... A47K 17/022 211/123
D646,957 S 10/2011 Syed et al.
D651,068 S * 12/2011 Kang ..... D8/363
8,079,476 B2 12/2011 Simms et al.
D660,687 S 5/2012 Fritz et al.
D668,490 S 10/2012 Yoo
D669,197 S 10/2012 Connor
D670,157 S 11/2012 Mo
D673,306 S 12/2012 Chung
D687,170 S 7/2013 Kovalchick
8,484,931 B2 7/2013 Gleeson et al.
D691,023 S 10/2013 Flintoff, Jr.
8,585,160 B2 * 11/2013 Atkins ..... A47F 10/06 248/122.1
D695,424 S 12/2013 Dionne et al.
D699,547 S 2/2014 Syed et al.
D701,451 S 3/2014 Momiyama
D702,104 S 4/2014 Butler
D705,044 S 5/2014 Hammac et al.
D705,447 S 5/2014 Chrien
D710,032 S 7/2014 Chrien
D711,012 S 8/2014 Jorge
8,844,084 B2 9/2014 Allen
D714,797 S 10/2014 Fujioka
D718,241 S 11/2014 Gretz
D719,820 S 12/2014 McGrath
8,898,977 B2 12/2014 Gulino
8,936,233 B1 1/2015 Sneith
8,944,414 B2 2/2015 Sprague
9,010,883 B2 * 4/2015 Scott ..... A47F 10/06 312/137
D739,960 S 9/2015 Britton
9,133,645 B2 * 9/2015 Toglia ..... E04H 17/1421
9,145,705 B2 * 9/2015 Herman ..... E04H 17/22
D740,367 S 10/2015 White
D744,321 S 12/2015 Boynton et al.
9,291,188 B2 * 3/2016 English ..... F16B 35/005
D753,931 S 4/2016 Schultz et al.
D754,260 S 4/2016 Chen et al.
D755,880 S 5/2016 Luo et al.
9,339,131 B1 * 5/2016 Christianson ..... A47F 10/06
D761,100 S 7/2016 Divers et al.
D764,070 S 8/2016 Lussier
9,435,124 B2 9/2016 Bezubic, Jr.
9,447,603 B2 * 9/2016 Simmons ..... E04H 17/22
D772,971 S 11/2016 Hojo et al.
D773,287 S 12/2016 Lida
D778,713 S 2/2017 McSweyn et al.
D779,311 S 2/2017 Honein
D781,688 S 3/2017 Honein
D785,210 S 4/2017 Honein
2003/0038281 A1 2/2003 Roark
2003/0159380 A1 8/2003 Doucet, Sr. et al.
2004/0055697 A1 3/2004 Eckelt et al.
2004/0118076 A1 6/2004 Bezubic, Jr.
2005/0246986 A1 11/2005 Dugger
2006/0175940 A1 * 8/2006 English ..... A47F 7/0071 312/137
2007/0193147 A1 8/2007 Dugger
2008/0078904 A1 * 4/2008 Trimble ..... E04F 11/1804 248/251
2011/0080075 A1 4/2011 Matus, Jr.
2011/0089390 A1 4/2011 Steinkraus
2013/0328004 A1 12/2013 Truckner
2014/0217347 A1 * 8/2014 Green ..... E04F 11/1812 256/66
2014/0323237 A1 10/2014 Beno et al.
2015/0102278 A1 * 4/2015 Pinheiro ..... E04F 11/1802 256/65.16
2015/0204105 A1 7/2015 Honein
2015/0247342 A1 9/2015 Honein
2015/0361671 A1 12/2015 Honein
2016/0073795 A1 3/2016 Matus, Jr.
2016/0145873 A1 * 5/2016 Green ..... E04F 11/1812 52/832
2016/0235222 A1 * 8/2016 Atkins ..... A47F 10/06
2016/0281752 A1 * 9/2016 Koller ..... F16B 2/04
2016/0298337 A1 * 10/2016 Header ..... E04F 11/1853
2016/0331155 A1 * 11/2016 Atkins ..... A47F 10/06
2017/0022717 A1 * 1/2017 Amendolea ..... E04F 11/1804

FOREIGN PATENT DOCUMENTS

CN 3573928 10/2006
CN 303290792 7/2015

(56) References Cited

FOREIGN PATENT DOCUMENTS

| | | |
|---|---|---|
| IN | 232265-0001 | 6/2011 |
| WO | D054064-005 | 2/2001 |

OTHER PUBLICATIONS

Aluminium Warehouse, "50 mm × 50 mm × 3mm : Aluminium Angle," URL=http://www.aluminiumwarehouse.co.uk/p29070/Aluminium_Angle_(6082T6)_50_mm_×_50_mm_×_3_mm/product_info.html, Sep. 14, 2015, 1 page.

INOX HBIX01-32 Handrail Bracket with 3-inch and 76.2mm Projection, Face Fixing, Bright Chrome, URL=http://www.amazon.com/INOX-HBIX01-32D-Handrail-Bracket-Projection/dp/B00IDZ9LRW?th=1, access date Jul. 27, 2017, 5 pages.

Design House 202655 Jumbo Hand Rail Bracket, Oil Rubbed Bronze Finish, URL=https://www.amazon.com/Design-House-202655-Bracket-Rubbed/dp/B002OFH2F0/ref=sr_1_4?ie—UTF8&qid=1501690420&sr=8-4&keywords=handrail+bracket, access date Aug. 2, 2017, 7 pages.

Stainless Steel Spigot Glass Railing System, URL=http://www.youtube.com/watch?v=n2Win-ouY9c, publish date Aug. 17, 2016, 1 page.

Stainless Steel Spigot Square Pyramid Glass Clamp New, URL=http://inlinedesign.us/products/stainless-steel-spigot-square-pyramid-glass-clamp, download date Jul. 31, 2017, 2 pages.

Amazon, "Stainless Steel Cone Handrail Bracket for Round Post," URL=https://www.amazon.com/Stainless-Steel-Handrail-Bracket-Round/dp/B011ALF3UE, download date Mar. 28, 2017, 3 pages

* cited by examiner

INTERCHANGEABLE BRACKET FLANGE SYSTEM

BACKGROUND

Technical Field

The present disclosure relates generally to systems for coupling brackets to a variety of surfaces.

Description of the Related Art

Handrails and other items are often coupled to walls or other surfaces using brackets or other coupling devices. In many cases, different brackets are used depending on the material of the wall or surface to which the handrail or other item is to be coupled. Currently, manufacturers typically create different brackets for each of the different installation surface media. For example, different brackets are often manufactured and used to couple handrails to wooden surfaces, metal surfaces, and glass surfaces.

BRIEF SUMMARY

An interchangeable bracket flange system may be summarized as comprising: a wall adaptor flange configured to connect a bracket to a wall; a glass adaptor flange configured to connect the bracket to a sheet of glass; and a steel adaptor flange configured to connect the bracket to a steel post.

The wall adaptor flange may have a first round base flange portion, the glass adaptor flange may have a second round base flange portion, and the steel adaptor flange may have a third round base flange portion. The wall adaptor flange may have a first screw coupled to and extending rearward away from a rear surface of the first round base portion, the glass adaptor flange may have a second screw coupled to and extending rearward away from a rear surface of the second round base portion, and the steel adaptor flange may have a third screw coupled to and extending rearward away from a rear surface of the third round base portion. The first screw may be configured to couple the wall adaptor flange to the wall with the first screw being hidden behind the first round base portion, the second screw may be configured to couple the glass adaptor flange to the sheet of glass with the second screw being hidden behind the second round base portion, and the third screw may be configured to couple the steel adaptor flange to the steel post with the third screw being hidden behind the third round base portion.

The wall adaptor flange may have a first adaptor flange column extending outward and forward from a center portion of the first round base flange portion, the glass adaptor flange may have a second adaptor flange column extending outward and forward from a center portion of the second round base flange portion, and the steel adaptor flange may have a third adaptor flange column extending outward and forward from a center portion of the third round base flange portion.

The first adaptor flange column may have a head portion including a hex head. The first adaptor flange column may have a head portion including a socket head. The first adaptor flange column may have a head portion including a Phillips head. The first round base flange portion may have a larger diameter than the third round base flange portion. The wall adaptor flange may be coupled to the bracket by a glue. The wall adaptor flange may be coupled to the bracket by an epoxy. The wall adaptor flange may be coupled to the bracket by a weld. The wall adaptor flange may be coupled to the bracket by a pointed head screw. The pointed head screw may extend through a portion of the bracket and engages with a channel formed in the wall adaptor flange to secure the bracket to the wall adaptor flange.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with the technology have not been shown or described in detail to avoid unnecessarily obscuring descriptions of the embodiments.

The interchangeable bracket flange systems described herein provide a modular and easy-to-use single bracket system that is configured to connect, couple, or install brackets such as handrail brackets to a wall such as a wooden or sheetrock wall, a post such as a steel post, or to a sheet of glass. The interchangeable bracket flange systems described herein include all-in-one brackets that can be used interchangeably as wooden wall brackets, metal post brackets, or glass brackets, and can be used with a variety of materials such as sheetrock, wood, steel, glass, etc. The interchangeable bracket flange systems described herein include a variety of adaptor flanges that can be fastened to a variety of materials without mounting screws or a base cover, creating a sleek and modern-looking design without sacrificing strength, and brackets that can be coupled to any one of the adaptor flanges.

A kit of interchangeable bracket flange system components can include wall adaptor flanges, used to connect brackets to wooden or sheetrock walls, such as walls with a sheetrock face and wood or steel studs, steel adaptor flanges, used to connect brackets to steel posts, glass adaptor flanges, used to connect brackets to sheets of glass, and brackets that can be coupled to any of the adaptor flanges. Each of the adaptor flanges can include a base flange portion and an adaptor flange column that projects away from a central portion of the base flange portion. Each of the adaptor flanges can also include a v-shaped channel or groove extending circumferentially around the adaptor flange column, the v-shaped channel being configured to receive or catch an end portion of a small pointed-head screw to couple the adaptor flange to a bracket during installation. A terminal end portion or head of the adaptor flange column can include a hex-head, socket-head, Phillips-head, Allen wrench head, star-shaped head, or any other type of head. The brackets can include hollow bracket columns and any one of the adaptor flanges can be coupled to a bracket by inserting the adaptor flange column of the adaptor flange into the bracket column of the bracket and securing the adaptor flange to the bracket with a small pointed-head screw.

Figure 1:
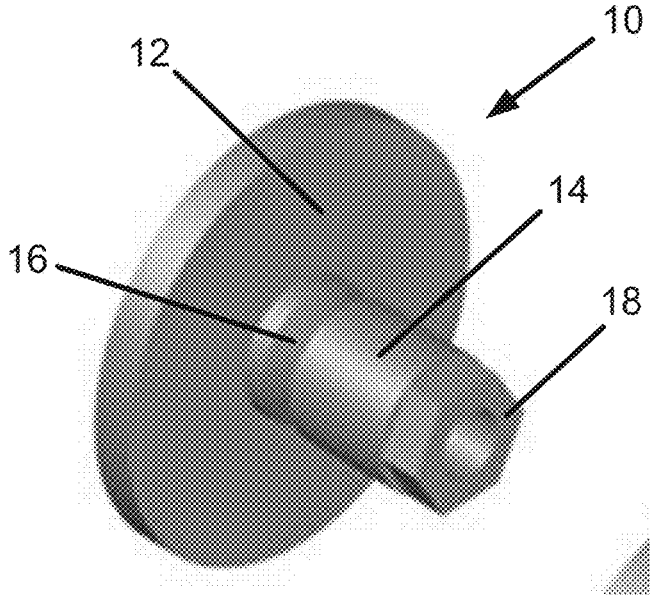
FIG. 1 shows a wall adaptor flange.
Figure 2:
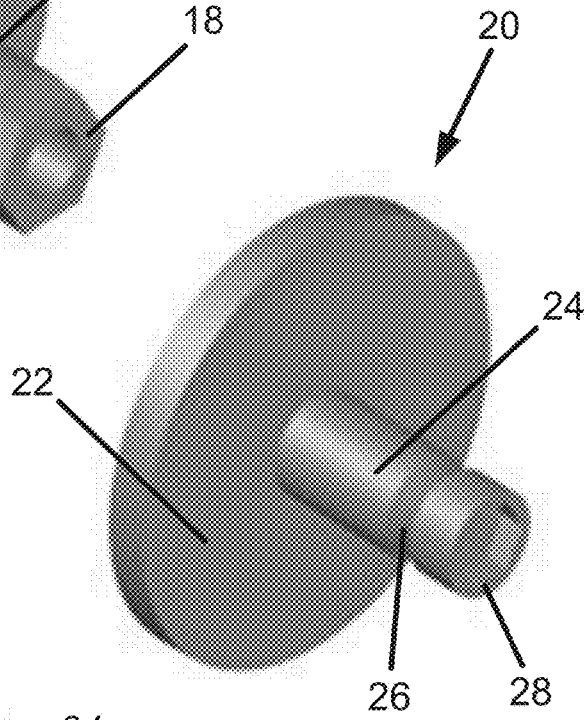
FIG. 2 shows another wall adaptor flange.
Figure 3:
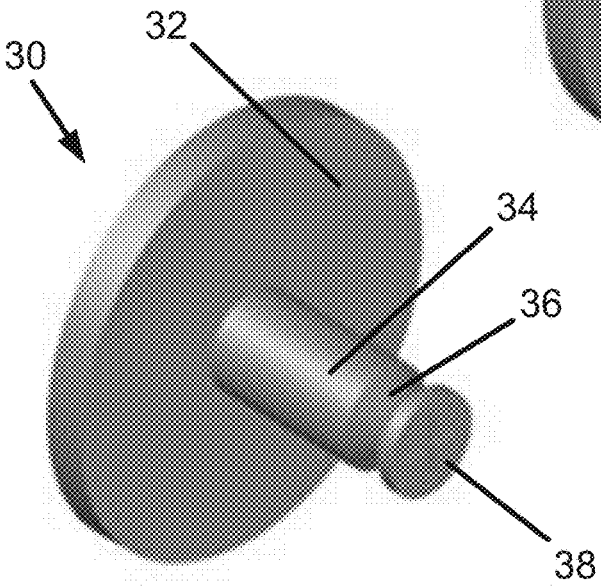
FIG. 3 shows another wall adaptor flange.

FIG. 1 illustrates a first wall adaptor flange 10 including a base flange portion 12 and a hollow adaptor flange column 14. The hollow adaptor flange column 14 includes a v-shaped channel 16 extending circumferentially around the adaptor flange column 14 at a location proximate the flange portion 12 and a hexagonal head 18. FIG. 2 illustrates a second wall adaptor flange 20 including a base flange portion 22 and an adaptor flange column 24. The adaptor flange column 24 includes a hex head or Allen wrench head 28 and a v-shaped channel 26 extending circumferentially around the adaptor flange column 24 at a location proximate the head 28. FIG. 3 illustrates a third wall adaptor flange 30 including a base flange portion 32 and an adaptor flange column 34. The adaptor flange column 34 includes a Phillips head 38 and a v-shaped channel 36 extending circumferentially around the adaptor flange column 34 at a location proximate the head 38.

Figure 4:
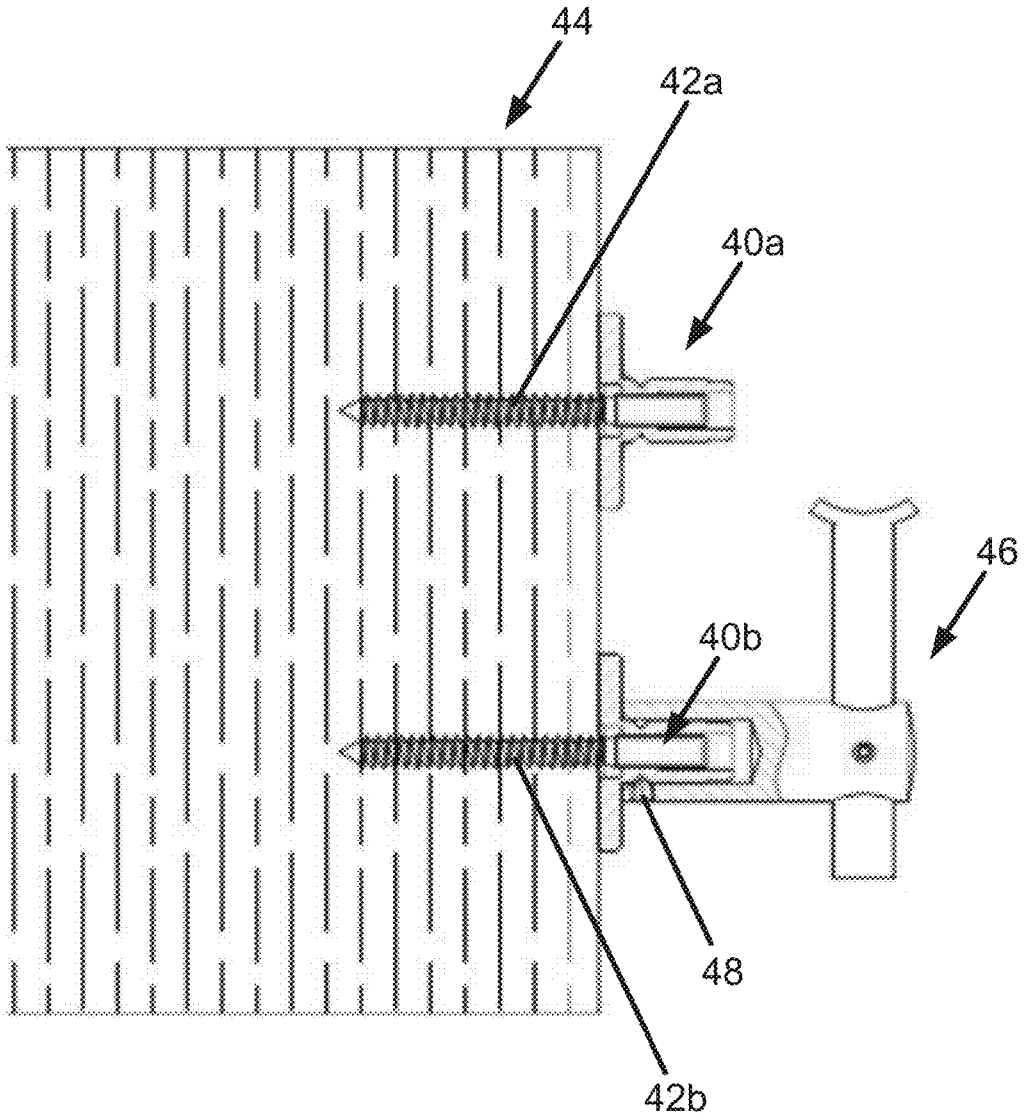
FIG. 4 shows a first wall adaptor flange coupled to a wall and a bracket coupled to a second wall adaptor flange coupled to the wall.

The base flange portions 12, 22, and 32 can be thin pieces of metal connected to the respective adaptor flange columns 14, 24, or 34. The base flange portions 12, 22, and 32 are illustrated as round and circular but can have any suitable or aesthetically pleasing shape, such as rectangular, square, etc., which can depend on the style of the bracket to be coupled to the adaptor flange. Circular base flange portions can be desirable because they can allow a user to rotate the adaptor flange and the base flange portions as needed during installation without changing its outward appearance. As illustrated in FIG. 4, anchor screws 42*a*, 42*b* can be rigidly coupled to each of the wall adaptor flanges 40*a*, 40*b*, to connect the wall adaptor flanges 40*a*, 40*b* to a wall 44. The anchor screws 42*a*, 42*b* can have machine threads on a first portion or a first end of the anchor screws 42*a*, 42*b*, which can be threaded into complementary threads internal to the wall adaptor flanges 40*a*, 40*b* and their hollow adaptor flange columns. The anchor screws 42*a*, 42*b* can also have lag threads on a second portion or second end of the anchor screws 42*a*, 42*b* that can be threaded into the wall 44. Thus, the anchor screws 42*a*, 42*b* can be adapter screws that thread into and between the steel of the wall adaptor flanges and the wood or steel stud of the wall 44.

FIG. 4 also shows a handrail bracket 46 installed on the wall adaptor flange 40*b* and thereby on the wall 44. A small pointed-head screw 48 extends through a bracket column of the handrail bracket 46 and is received within and engages with a v-shaped channel of the wall adaptor flange 40*b* to lock the bracket 46 to the wall adaptor flange 40*b* and thereby to the wall 44. The handrail bracket 46 is able to withstand at least 200 pounds of force down to meet the relevant code provisions. Connecting surfaces of the wall 44 such as wood or sheetrock can be easily deformable with this amount of force over time. The wall adaptor flange 40*b* and a base flange portion thereof are configured to distribute such forces over a larger portion of the wall 44 to prevent or reduce deterioration or deformation of the wall 44.

Figure 5:
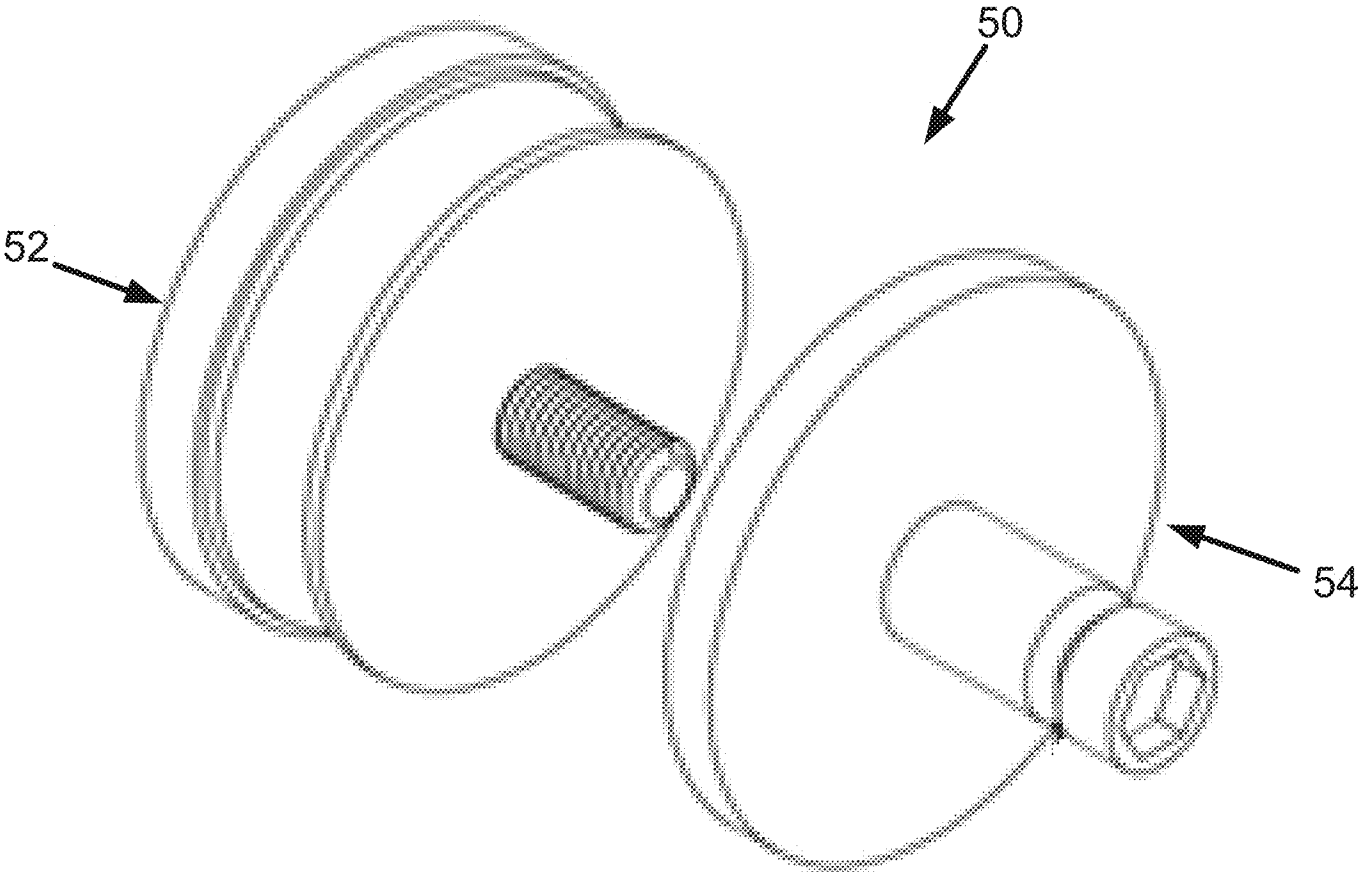
FIG. 5 shows a glass adaptor flange.
Figure 6:
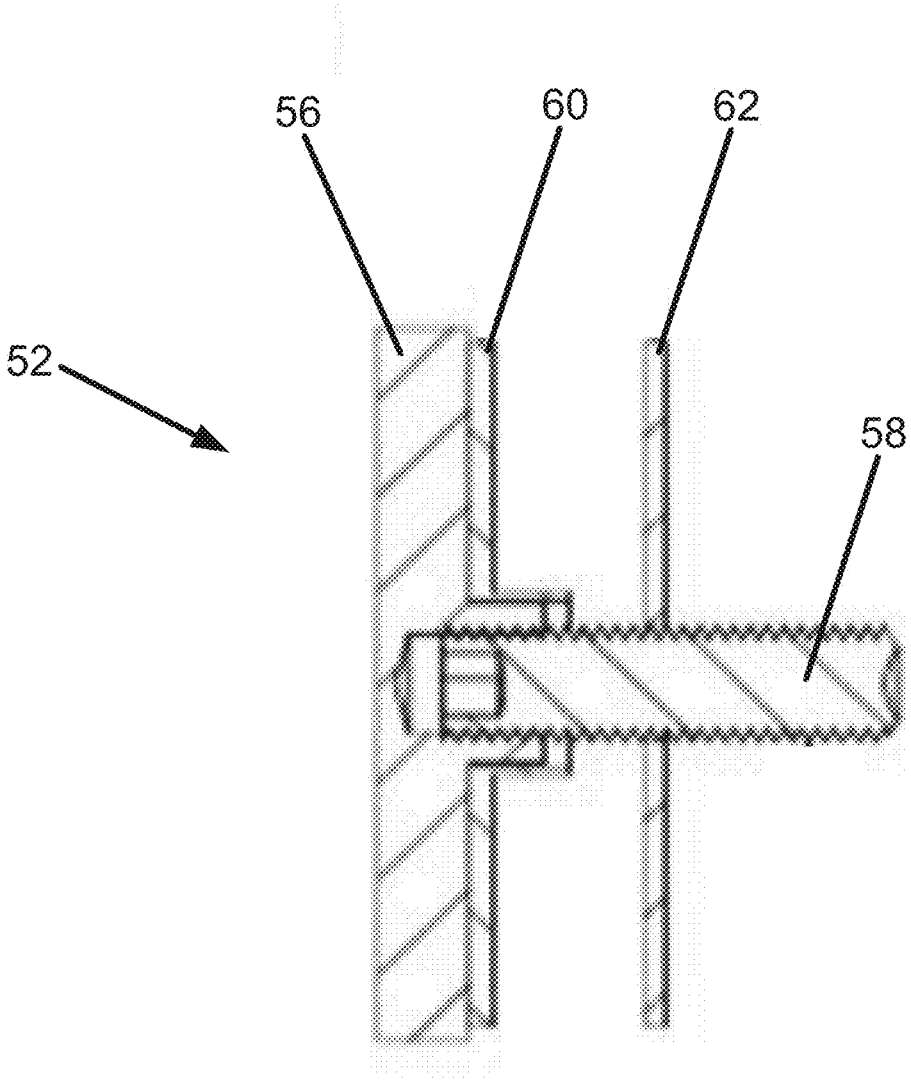
FIG. 6 shows a cross-sectional view of a portion of the glass adaptor flange of FIG. 5.
Figure 7:
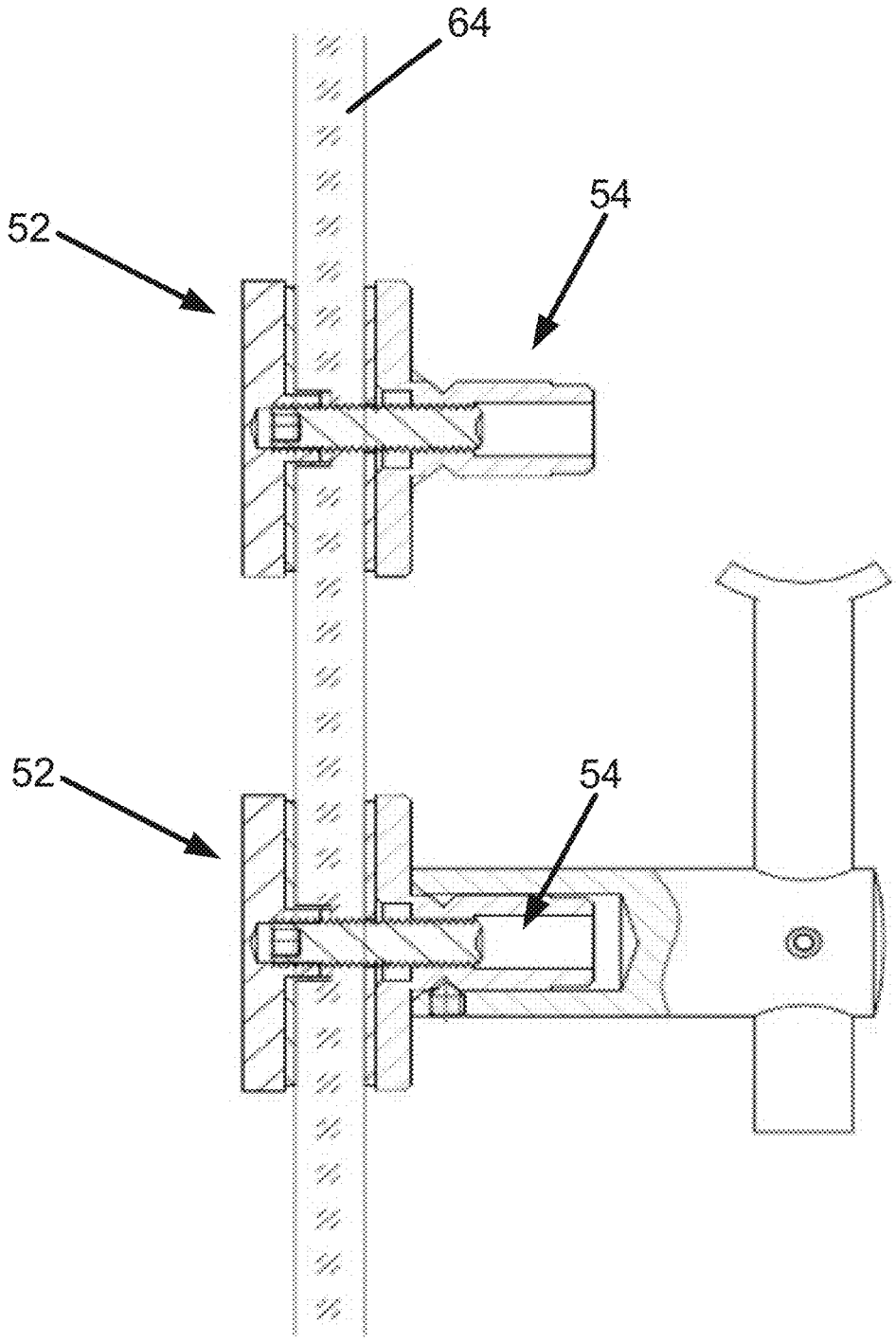
FIG. 7 shows a cross-sectional view of a glass adaptor flange coupled to a sheet of glass and a bracket coupled to another glass adaptor flange coupled to the sheet of glass.
Figure 8:
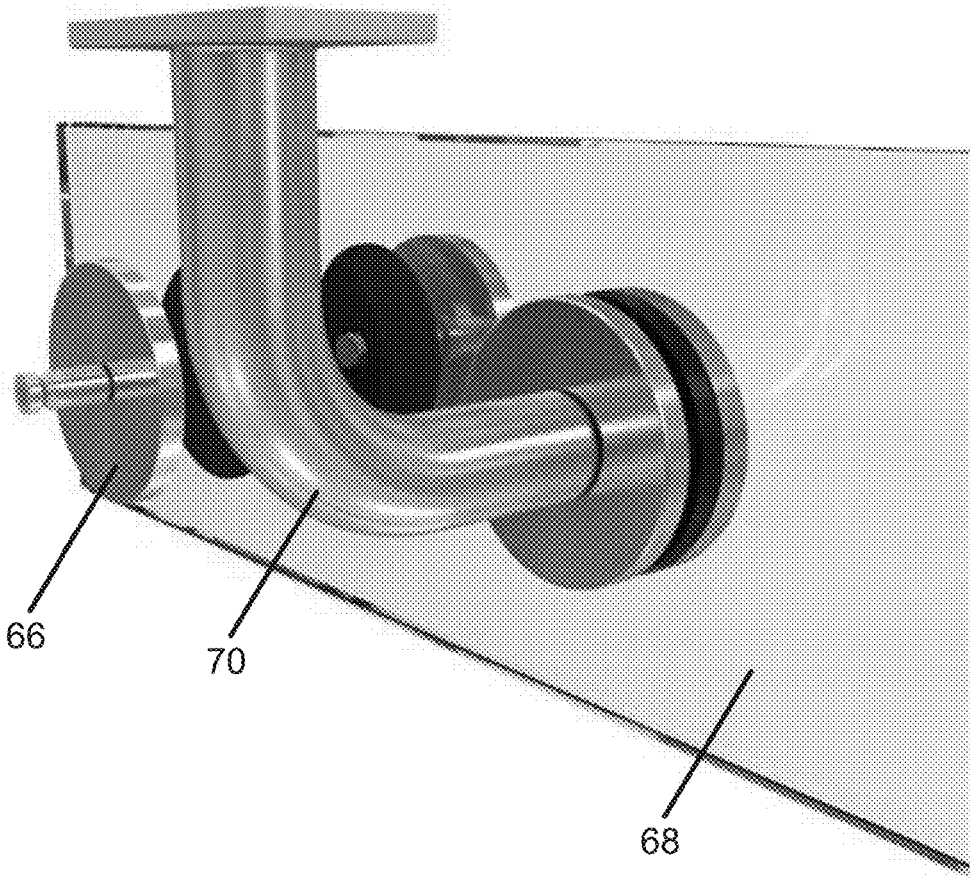
FIG. 8 is a photograph of a glass adaptor flange coupled to a sheet of glass and a bracket coupled to another glass adaptor flange coupled to the sheet of glass.

FIG. 5 illustrates a glass adaptor flange 50, which includes a rear portion 52 and a front portion 54, the front portion 54 being identical to the wall adaptor flange 20. FIG. 6 illustrates the rear portion 52 in greater detail. As seen in FIG. 6, the rear portion 52 includes a base flange portion 56 and a threaded rod 58 extending away from a central portion of the base flange portion 56. The rear portion 52 also includes a pair of rubber gaskets 60, 62, mounted on the threaded rod 58. To mount the glass adaptor flange 50 to a sheet of glass 64, as illustrated in FIG. 7, a user can position the rear portion 52 on a first side of the sheet of glass 64 with the threaded rod 58 extending through an opening in the sheet of glass 64 such that the pair of gaskets 60, 62 are on opposite sides of and pressed in direct contact against the sheet of glass 64. The user can then thread the front portion 54 of the glass adaptor flange 50 onto the end of the threaded rod 58 so that the rear portion 52 and front portion 54 are on opposite sides of the sheet of glass 64. The pair of gaskets 60 and 62 are positioned between the base flange portion 56 and the sheet of glass 64 and between the front portion 54 and the sheet of glass 64, respectively, to protect the sheet of glass. The sheet of glass can be at least one half inch thick and can be tempered or laminated. FIG. 8 illustrates a glass adaptor flange 66 coupled to a sheet of glass 68 and a bracket 70 coupled to another glass adaptor flange coupled to the sheet of glass 68.

Figure 10:
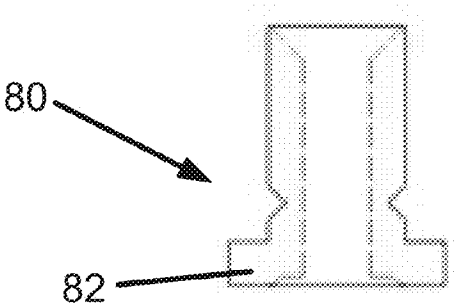
FIG. 10 shows a cross-sectional side view of the steel adaptor flange of FIG. 9.
Figure 9:
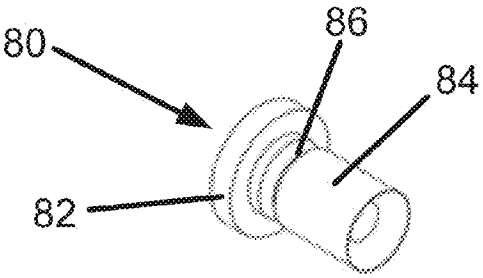
FIG. 9 shows a steel adaptor flange.

FIGS. 9 and 10 show perspective and cross-sectional side views, respectively, of a first steel adaptor flange 80. The first steel adaptor flange 80 is similar to the wall adaptor flange 10 but has a base flange portion 82 having a smaller diameter than the base flange portion 12 of the wall adaptor flange 10. The base flange portion 82 has a smaller diameter than the base flange portion 12 because the base flange portion 82 is configured to be coupled to steel, and steel posts in particular, rather than to wood or sheetrock walls. Thus, due to the greater strength and rigidity of steel compared to wood and sheetrock, the base flange portion 82 can distribute forces over areas smaller than for the base flange portion 12 while still preventing or reducing deterioration. Further, the smaller base flange portion 82 can look more aesthetically pleasing than the base flange portion 12 when coupled to a post. The steel adaptor flange 80 also includes an adaptor flange column 84 and a v-shaped channel 86 extending circumferentially around the adaptor flange column 84 at a location proximate the flange portion 82.

Figure 14:
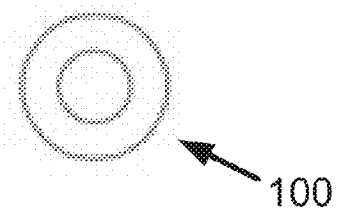
FIG. 14 shows a top view of the round post adaptor of FIG. 13.
Figure 13:
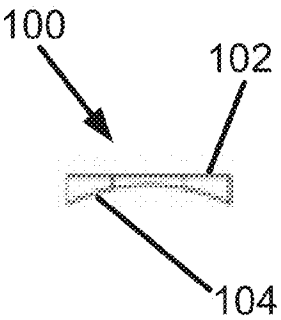
FIG. 13 shows a side view of a round post adaptor.
Figure 12:
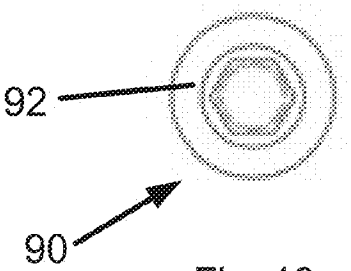
FIG. 12 shows a top view of the steel adaptor flange of FIG. 11.
Figure 11:
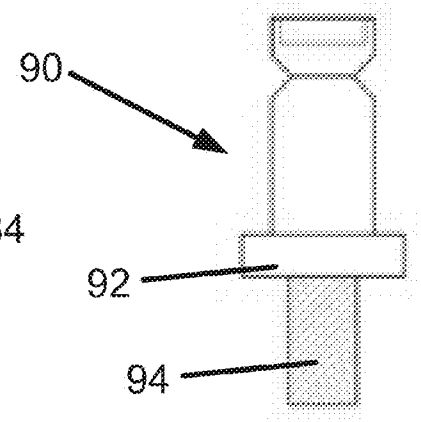
FIG. 11 shows a side view of another steel adaptor flange.

FIGS. 11 and 12 show a side view and a top view, respectively, of a second steel adaptor flange 90. The second steel adaptor flange 90 is identical to the wall adaptor flange 20 except that it includes a base flange portion 92 having a smaller diameter than the base flange portion 22. FIGS. 11 and 12 illustrate that a first portion of a threaded rod 94 can be welded to the second steel adaptor flange 90 or threaded into an internal hollow portion of the second steel adaptor flange 90 such that a second portion of the threaded rod 94 extends out away from the steel adaptor flange 90 to be engaged with a steel post. FIGS. 13-14 show side and top views, respectively, of a round post adaptor 100. The round post adaptor 100 can be a washer with a first, flat surface 102 and a second, concave surface 104. The round post adaptor 100 can be positioned on the threaded rod 94 with the flat surface 102 against the base flange portion 92 to allow the steel adaptor flange 90 to be snugly coupled to a round steel post.

To couple a bracket to a steel post, a user can position a steel post having a hole formed in a side surface thereof in a desired location. The hole in the steel post can be threaded (such as can be achieved by a flow drilling process) to receive the threaded rod 94 or the hole can be unthreaded and the user can insert a rivet nut into the unthreaded hole to receive the threaded rod 94. A surface of a base flange portion of a steel adaptor flange configured to engage a steel post and the curved surface 104 of the round post adaptor 100 can each include a recessed area to accommodate a flange of a rivet nut in case a rivet nut is used. Once a steel adaptor flange is mounted to the surface of the steel post, the user can couple a bracket to the steel adaptor flange as described above, using a small pointed-head screw.

Figure 15:
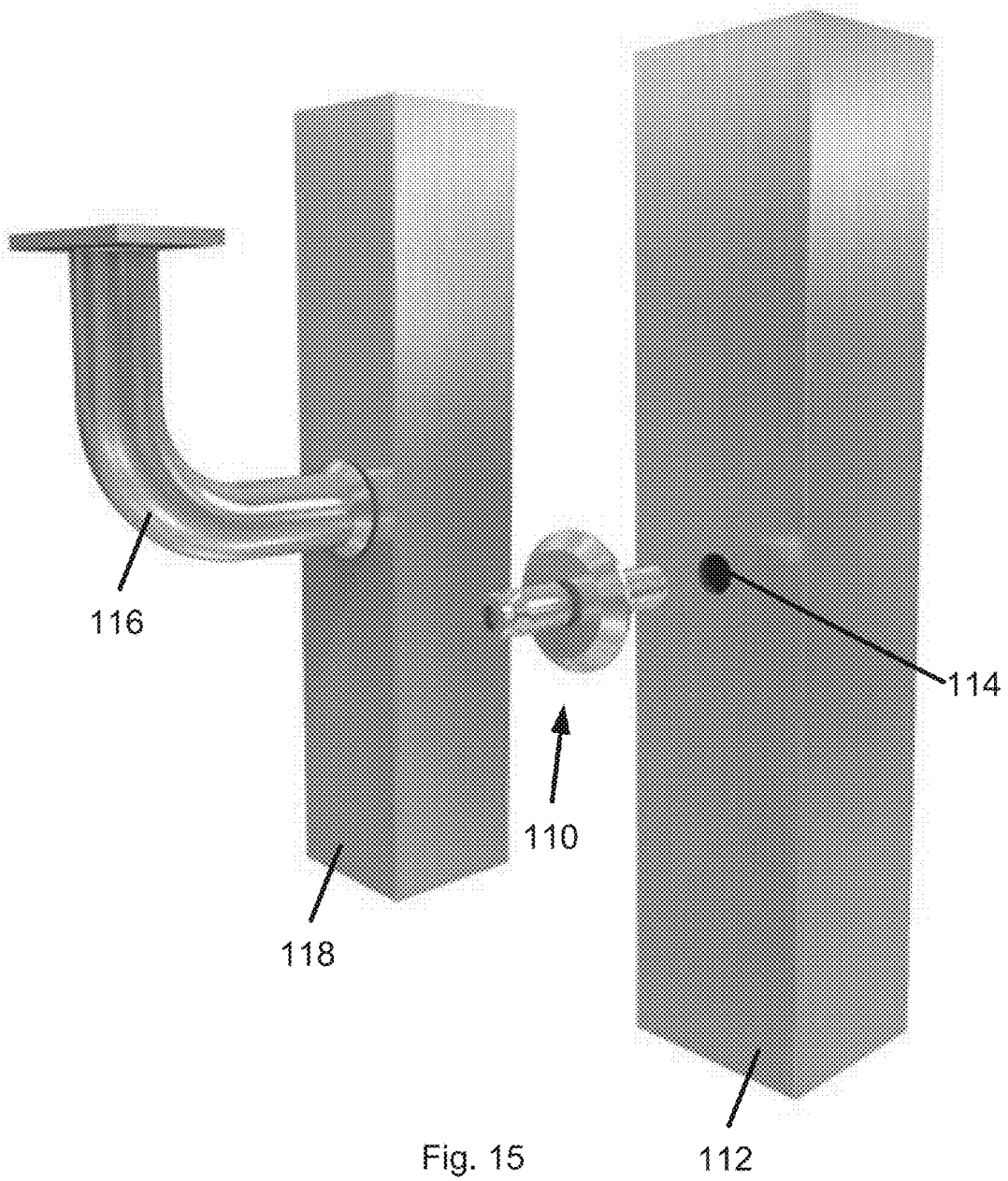
FIG. 15 shows a steel adaptor flange being coupled to a steel tube with a threaded hole, and a bracket coupled to another steel adaptor flange coupled to another steel tube.
Figure 16:
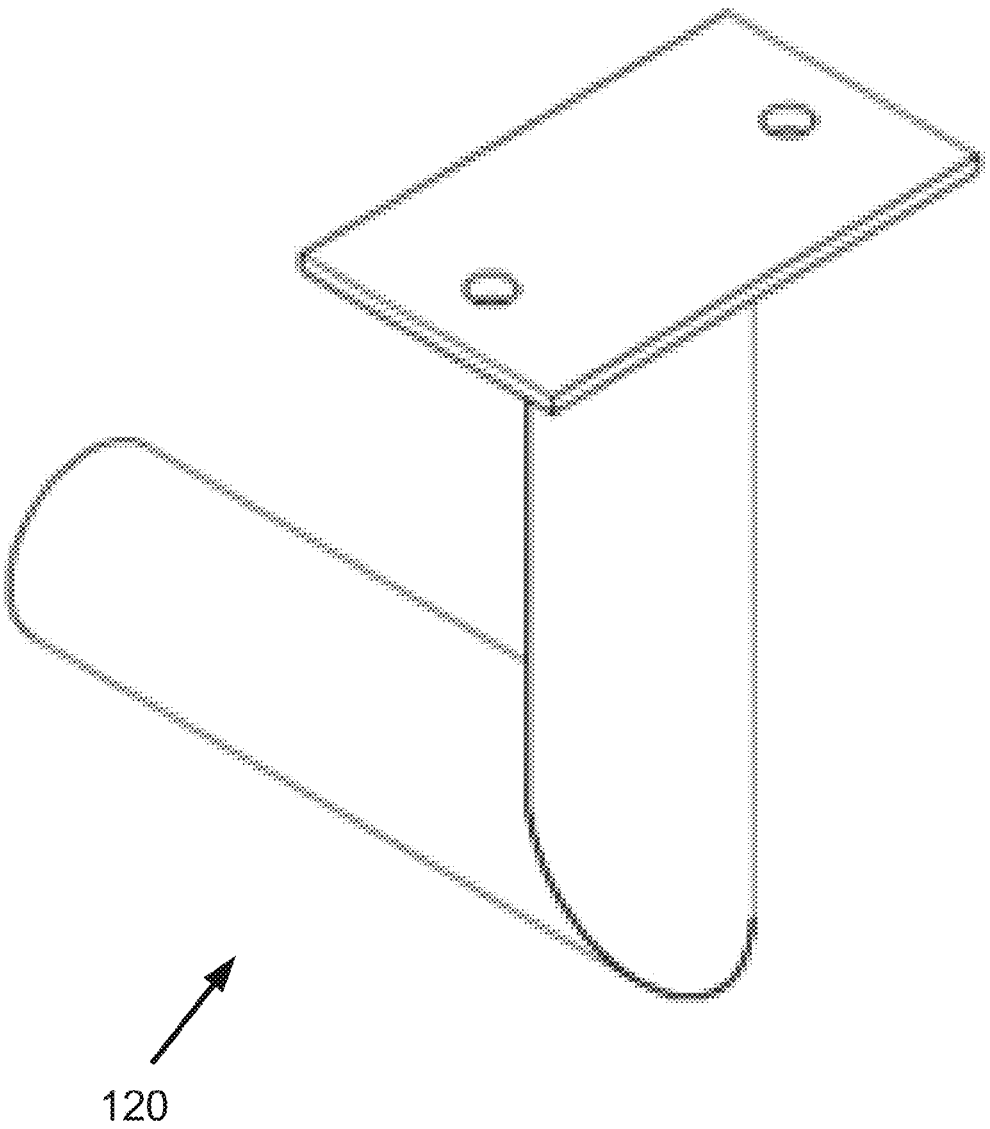
FIG. 16 shows a bracket that can be coupled to any one of the adaptor flanges described herein.

FIG. 15 shows a steel adaptor flange 110 being coupled to a steel tube 112 having a threaded hole 114 in a side surface thereof, and a bracket 116 that is coupled to another steel adaptor flange coupled to another steel tube 118. FIG. 16 shows a bracket 120 that can be coupled to any one of the adaptor flanges described herein.

U.S. patent application Ser. No. 14/751,505, filed Jun. 26, 2015, which was converted to U.S. Provisional Patent Application No. 62/495,581, filed Jun. 26, 2015, to which this application claims priority, is hereby incorporated herein by reference in its entirety. The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. An interchangeable bracket flange system comprising:

a plurality of base flange portions each having a front surface and a rear surface, each rear surface having a respective one of a male or female attachment member;

a plurality of rear rod-like members, each having a respective other of the male or female attachment member that attaches to the respective one of the male or female attachment member so that each of said rear rod-like members extends perpendicularly from each respective rear surface, said rear rod-like members detachable from said one of the male or female attachment member;

said rear rod-like members each having a respective further attachment member away from said respective other of said male or female attachment member for attaching each of said rear rod-like members to a respective further object;

a front projecting member extending perpendicularly from said front surface, respectively, said front projecting member having a respective torque member for receiving torque that is transmitted to said base flange portions, respectively;

a plurality of brackets from sliding over said front projecting member, respectively, said brackets each having a bracket attachment member for rigidly attaching said brackets to said front projecting member, respectively, wherein said one of said male Or female member included in each of said base flange portions is identical.

2. The interchangeable bracket flange system of claim 1, wherein the front projecting member has a radial channel to receive a pointed head screw disposed a handrail bracket to secure the handrail bracket to the front projecting member.

3. An interchangeable bracket flange system according to claim 1, wherein said rear rod-like member is selected from the group consisting of at least two of:

a) a thread-forming screw;

b) a non thread-forming bolt; and c) a bolt assembly that includes a further flange that attaches to said further attachment member and a plurality of rubber gaskets situated between said rear surface and said further flange.

4. An interchangeable bracket flange system according to claim 1, wherein said rear rod-like member are:

a) a thread-forming screw;

b) a non thread-forming bolt; and c) a bolt assembly that includes a further flange that attaches to said further attachment member and a plurality of rubber gaskets situated between said rear surface and said further flange.

5. An interchangeable bracket flange system according to claim 1, wherein said interchangeable bracket flange system is one of a plurality of interchangeable bracket flange systems, and wherein in each of said plurality of interchangeable bracket flange systems:

said another of said male or female member included in each of said rear rod like members is identical; and said further attachment member included in each of said rear rod like members is different.

* * * * *